US006149766A

United States Patent [19]

Tibbling et al.

[11] Patent Number: 6,149,766

[45] **Date of Patent: *Nov. 21, 2000**

[54] PROCESS FOR PEROXIDE BLEACHING OF CHEMICAL PULP IN A PRESSURIZED BLEACHING VESSEL

[75] Inventors: Petter Tibbling, Vålberg; Ulla Ekström, Karlstad; Erik Nilsson, Väse; Lars-Ove Larsson, Karlstad, all of Sweden

[73] Assignee: Kvaerner Pulping Technologies, A/B, Karlstad, Sweden

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/740,832

[22] Filed: Nov. 4, 1996

Related U.S. Application Data

[62] Division of application No. 08/244,637, Jun. 7, 1996, Pat. No. 5,571,377.

[30] Foreign Application Priority Data

Jun. 8, 1993 [SE] Sweden ..... 9301960

[51] Int. Cl.[7] ..... D21C 9/153; D21C 9/16

[52] U.S. Cl. ..... 162/52; 162/65; 162/76; 162/78

[58] Field of Search ..... 162/76, 78, 65, 162/52, 233, 57

[56] References Cited

U.S. PATENT DOCUMENTS

| | | | |
|---|---|---|---|
| 3,619,110 | 10/1968 | Borzee | 162/78 |
| 3,719,552 | 3/1973 | Farley | 162/65 |
| 4,732,650 | 3/1988 | Michalowski et al. | 162/78 |
| 4,756,798 | 7/1988 | Lachenal et al. | 162/65 |

FOREIGN PATENT DOCUMENTS

| | | | |
|---|---|---|---|
| 402335 | 12/1990 | European Pat. Off. | 162/78 |

OTHER PUBLICATIONS

Singh, "The Bleaching of Pulp"; Tappi Press, Atlanta, GA, p. 543, 1979.

Lachenal et al; "The Potential of H2O2 as Delignifying and Bleaching Agent", 1992 Pacific Pulp & Paper Conf., p. 33–38.

*Primary Examiner*—Steve Alvo
*Attorney, Agent, or Firm*—Dorsey & Whitney, L.L.P.

[57] ABSTRACT

A process for chlorine-free bleaching of chemical pulp in association with the production thereof, where a suspension of the pulp preferably has a concentration exceeding 8% of cellulose-containing fiber material and where the pulp entering into a bleaching line is preferably fed continuously through at least one bleaching vessel in the bleaching line, is treated with at least one acid for adjusting the pH to a value below 7, and with a chelating agent, and is subsequently bleached in at least one stage to a brightness exceeding 75% ISO, preferably exceeding 80%, with hydrogen peroxide or the corresponding quantity of another peroxide, employed in a quantity exceeding 5 kg/BDMT, where the peroxide bleaching takes place at elevated temperature and at a pressure in the bleaching vessel which exceeds 2 bar and where the cross-sectional area of the bleaching vessel exceeds 3 $m^2$ and the area of the metal surface exposed towards the interior of the bleaching vessel is less than 4V $m^2$, where V indicates the volume in $m^3$.

25 Claims, 14 Drawing Sheets

PROCESS FOR PEROXIDE BLEACHING OF CHEMICAL PULP IN A PRESSURIZED BLEACHING VESSEL

This application is a division of application Ser. No. 08/244,637 filed Jun. 7, 1996 U.S. Pat. No. 5,571,377.

The invention relates to a process for chlorine-free bleaching of chemical pulp in association with production of the same, in which a suspension of the pulp preferably has a consistency exceeding 8% of cellulose-containing fibre material and in which the pulp entering into a bleaching line is preferably fed continuously through at least one bleaching vessel in the bleaching line, is treated with at least one acid for adjusting the pH to a value below 7 and with a chelating agent, and is subsequently bleached in at least one stage to a brightness exceeding 75% ISO, preferably exceeding 80%, using hydrogen peroxide or a corresponding quantity of another peroxide, added in a quantity exceeding 5 kg/BDMT.

Marketing and environmental considerations have demanded that extensive efforts be made to eliminate the use of chlorine-containing compounds for bleaching purposes. Using current technology, it is difficult to achieve complete bleaching of paper pulp prepared from soft wood sulphate pulp using oxygen, hydrogen peroxide and ozone.

There are a number of peroxide bleaching processes of the Lignox and Macrox type in which a combination of EDTA treatment and peroxide addition is used. These processes require a minimum of a 4-hour reaction time at 90° C. and, despite this, it is found that when a successful bleaching of oxygen-delignified soft-wood pulp has been carried out, with the pulp having a kappa of 12 and with a brightness of 77–79 ISO having been achieved, about half of the quantity of peroxide employed remains unused. The intention is that the latter should subsequently be returned to the process for reuse after the addition of fresh peroxide. As far as we know, this still does not take place on a factory scale. In some cases, the peroxide is returned to the oxygen reactor, with any possible brightness-increasing effect being negligible.

Through the Swedish Patent Application, laid open, 8503153-2 (Wagner-Biró AG), a process is known for delignifying pulp using oxygen and/or ozone with the possible addition of peroxide. In the said process, the pulp is placed in contact with oxygen, possibly in the presence of peroxide, at a temperature of 80° C. to 150° C. An alkalising supplement is then added to the pulp. The process can be repeated in several stages with increasing pressures and/or temperatures. This process is based on a two-stage process where the first stage takes place, in this case, at a consistency of 2.5–4.5% and the second stage is carried out at a consistency of 10%. The quantity of peroxide employed is 0–5 kg of $H_2O_2$ per kg of ptp.

An approach which might seem to present itself immediately would be to raise the temperature and apply pressure in order to shorten the necessary reaction time and/or decrease the peroxide residue in order to achieve optimal utilisation of the hydrogen peroxide employed, and this suggestion is in fact included as a possibility in the Swedish Patent 8902058-0 (EKA Nobel AB) in which the so-called Lignox process is described. Experiments in this direction have been carried out, but have failed, the results in all respects being worse than those achieved with purely atmospheric peroxide bleaching. It has even been suggested that oxygen is of no value in bleaching by the Lignox method. The application of pressure is preferably carried out using an MC pump, with the pumped suspension having a consistency exceeding 8% and preferably less than 18%.

It should be noted that experiments to which reference has been made in the patent and other literature have, for understandable reasons, been carried out on a laboratory scale. Indications have been obtained that the results are worse if the temperature is increased (for example from 90° C. to 95° C.) and the conclusion has been drawn that peroxide bleaching should preferably take place at a temperature below 90° C.

SUMMARY OF THE INVENTION

The object of the present invention is to produce a process of the type mentioned in the introduction which provides efficient and more homogeneous bleaching.

This is achieved, according to the invention, by the peroxide bleaching taking place at elevated temperature and at a pressure in the bleaching vessel which exceeds 2 bar, by the cross-sectional area of the bleaching vessel exceeding 3 $m^2$, and by the area of the metal surface exposed towards the interior of the bleaching vessel being less than 4V $m^2$, where V indicates the volume in $m^3$.

It can be added that, in laboratory bleachings, plastic bags are used under conditions of atmospheric pressure in a waterbath whose temperature is maximally 90° C.–95° C. For obvious reasons, pressurised procedures in a gas atmosphere are carried out in acid-resistant autoclaves.

It has now emerged, surprisingly, that the hot metal surface of the autoclave catalyses decomposition of the peroxide. Brightness, kappa number and viscosity all reach improved values in association with lower consumption of peroxide if the pulp and the peroxide are placed together in a sealed plastic bag before the bag is put into the autoclave which is filled with water for heat transfer between the autoclave and the bag. Experiments have been carried out both with and without the application of an extra (5 bar) oxygen pressure. Without entirely espousing a particular theory, it can be supposed that a plausible mechanism for this could be that the hot metal surfaces of the autoclave catalyse decomposition of the peroxide. To investigate this, the experiments described below, inter alia, were carried out. These experiments demonstrated that our assumption was correct. Since the quantity of inwardly exposed metal surface per unit of volume in a vessel decreases quadratically with regard to the increase in volume of the vessel, we have been able to conclude that the above-mentioned problem is laboratory-specific, i.e. at a particular value of the cross-sectional area of the bleaching vessel (circa 3 $m^2$, which effect consequently decreases further with increased cross-sectional area~D) this effect is marginal.

It has also emerged surprisingly that a further improve of the process according to the invention is obtained by using a complexing agent which is capable of withstanding higher pH values without being broken down. With higher pH values is meant values up to 11.

It is know within the state of the art to wash the pulp suspension after the complexing agent, e.g. EDTA, has been added in the Q stage, in order first to bind and then to wash out the transition elements present in the pulp suspension. A certain amount of the metal bound by the EDTA, however, will remain in the suspension and be carried over into the next stage. Moreover, there may still be metal not bound by the EDTA which also remains.

At the pH values existing in the next stage it appears that the metals complexly bound by EDTA will be freed since EDTA does not withstand the pH values used in the bleaching stage. The freed metal ions, as well as those never bound, have a detrimental effect on the continued process since they decompose the peroxide used in the bleaching.

Thus it has proved to be an improvement to the process according to the invention, after the Q-stage, preferably together with the peroxide, to add an amount of a complexing agent, which is capable of withstanding high pH-values without decomposition. By this addition the disadvantages referred to above will be removed. According to the invention a preferred complexing agent is DTPA.

It has also emerged that a further improvement of the process according to the invention is obtained by supplying oxygen, in conjunction with the bleaching, in a quantity which is less than 5 kg/BDMT, preferably less than 3 kg/BDMT and more preferably less than 1 kg/BDMT. It has also been found that nitrogen can be used instead of oxygen, resulting in only a small increase in the consumption of peroxide.

According to a further aspect of the invention, the process is improved by the temperature during the bleaching exceeding 90° C., preferably equalling or exceeding 100° C., and more preferably being between 100° C. and 105° C.

According to a further aspect of the invention, the process is improved by the quantity of peroxide employed exceeding 10 kg/BDMT and being less than 35 kg/BDMT in order to achieve a brightness exceeding 85 ISO.

According to a further aspect of the invention, the process is improved by the pressure exceeding 3 bar, preferably being within the interval 5 to 15 bar and more preferably within the interval 5 to 10 bar.

According to a further aspect of the invention, the process is improved by the pulp, during the bleaching, not being permitted to any significant extent to come into contact with metal surfaces, with preferably at least the inner surface of the bleaching vessel being made of some polymeric or ceramic material.

According to a further aspect of the invention, the process is improved by the Q stage being preceded by a Z stage or by a peracetic acid stage and by a brightness exceeding 85 ISO being obtained with the aid of such a 2-stage process in association with a consumption of peroxide which is less than 20 kg/BDMT.

According to a further aspect of the invention, the process is improved by no washing taking place between ZQ, and preferably by an A stage preceding the Z stage.

According to a further aspect of the invention, the manganese content should be less than 5 g/BDMT of pulp, preferably less than 1 g/BDMT of pulp, and more preferably less than 0.5 g/BDMT of pulp, in the pulp for the peroxide stage, which is largely the same as the content in the finally bleached pulp.

According to a further aspect of the invention, the process is improved by, at the bleaching stage, a pH-elevating agent first being added to the pulp suspension prior to the peroxide being mixed in at a temperature of less than 90° C., before the temperature is finally raised to the desired level for carrying out the bleaching itself.

According to a further aspect of the invention, the process is improved by, at addition of the pH-elevating agent to the pulp suspension in the bleaching stage preceeding the addition of the peroxide, the initial pH-value not being raised higher than 11.5, preferably the pH-value is adjusted to a value between 10 and 11.

According to a further aspect of the invention, the process is improved by at least one complexing agent participating in the peroxide bleaching stage, which complexing agent preferably is added to the suspension together with the peroxide.

According to a further aspect of the invention, the process is improved by one of the at least one complexing agents being one, which substantially withstands a pH-value up to 11, this complexing agent preferably being DTPA.

According to a further aspect of the invention, the process is improved by the complexing agent DTPA being added in an amount preferably between 1 and 2 kg DTPA/ADMT According to a further aspect of the invention, the process is improved by the positive pressure in the bleaching vessel being obtained with the aid of a centrifugal pump, a so-called MC pump.

According to a further aspect of the invention, the process is improved by the peroxide bleaching being carried out hydraulically, with no gas phase being present in the bleaching vessel.

According to a further aspect of the invention, the process is improved by the diameter of the bleaching vessel exceeding 3 meters, preferably 5 meters and more preferably 7 meters.

The examples below illustrate the invention and demonstrate the surprising and unexpected result.

BRIEF DESCRIPTION OF THE DRAWINGS

In conjunction with the description below, reference is also made to the accompanying diagrams where.

COMPARATIVE EXAMPLES

Figure 1:
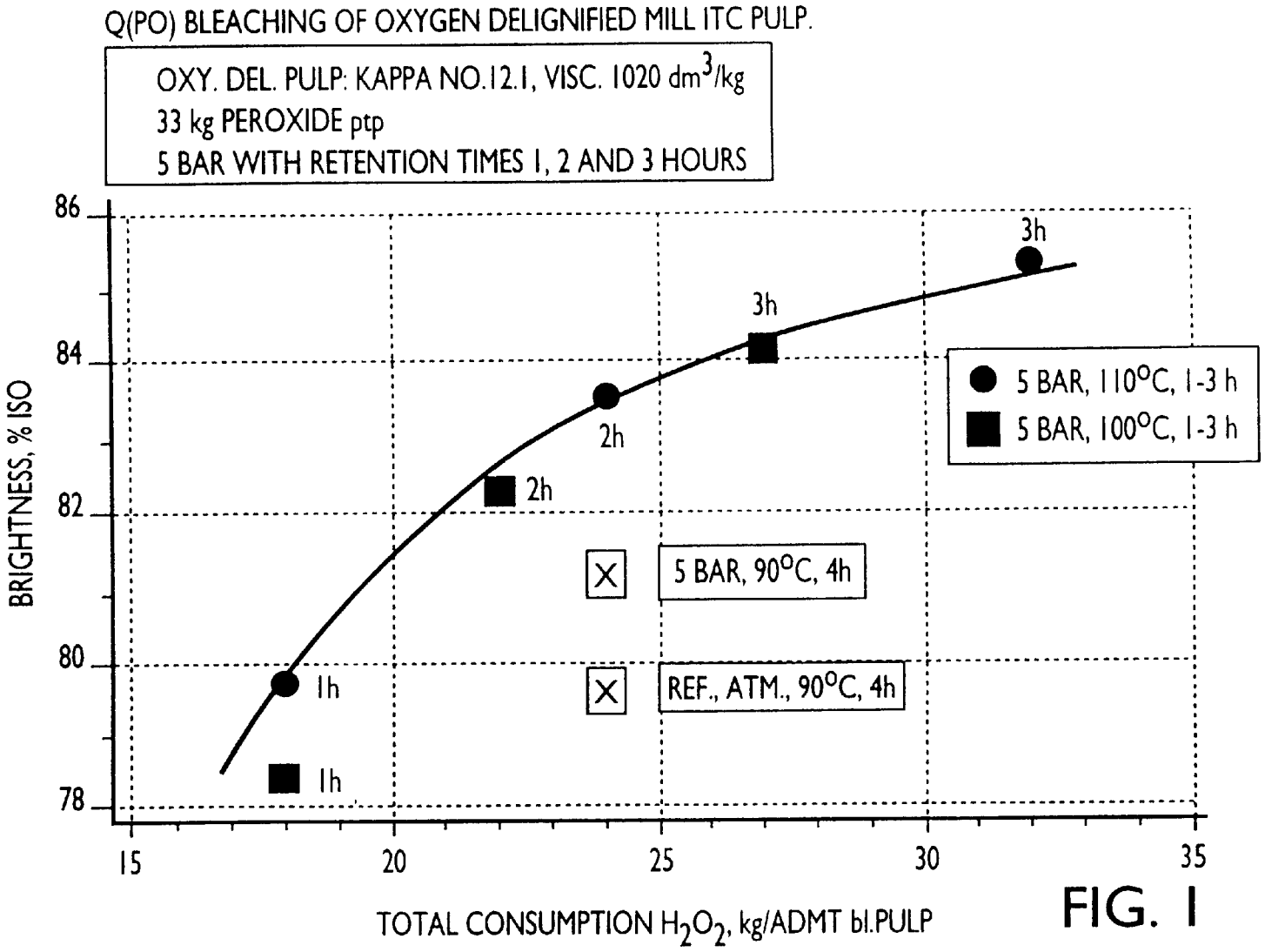
FIG. 1. shows a diagram of the relationship, during bleaching according to the invention, between brightness, % ISO and total consumption of $H_2O_2$ kg/ADMT, at either 5 bar and 100° C. or 5 bar and 110° C. for 1, 2 and 3 hours, and at 90° C., 0 bar and 4 hours, and at 90° C., 5 bar and 4 hours.

O(Pressurised P)-bleaching of Oxygen-delignified Soft Wood Pulp

In order to demonstrate the effect of, on the one hand, the difference from pulp suspension which is bleached in direct contact with metal surfaces in the bleaching vessel and of, on the other hand, the effect of applying a pressure, as well as indirectly the effect of raising the temperature during the process, since when the autoclaves are filled with water round the plastic bags a much improved heat transfer to the pulp suspension is obtained, the following experiments were carried out.

A pulp with a kappa number of 12.1, a consistency of 10% and a viscosity of 1020 $dm^3/kg$, was treated with EDTA in a Q stage, temperature 70° C., initial pH ($H_2SO_4$) 4.7 and a final pH equal to 5.0. The pulp treated in this way was subsequently subjected to an EOP stage at a consistency of 10% and during a period of 240 min and at the temperature of 90° C. This stage was carried out under normal pressure column a, b and c, as well as with 5 bar of positive pressure (oxygen atmosphere). The result is shown in the table below.

TABLE I

| | a | b | c | d | e | f |
|---|---|---|---|---|---|---|
| Consistency, % | | | 10 | | | |
| Temperature, ° C. | | | 90 | | | |
| Time, minutes | | | 240 | | | |
| | * | ** | **** | * | ** | *** |
| Average pressure, bar (excess) | 0 | 0 | 0 | 5 | 5 | 5 |
| $MgSo_4$, kg/BDMT | 3 | 3 | 3 | 3 | 3 | 3 |
| $H_2O_2$, kg/BDMT | 35 | 35 | 35 | 35 | 35 | 35 |
| NaOH, kg/BDMT | 25 | 25 | 25 | 25 | 25 | 25 |
| Consumption of $H_2O_2$, kg/BDMT | 33.0 | 26.4 | 25.7 | 33.3 | 23.7 | 25.3 |
| Final pH | 11.2 | 10.9 | 10.9 | 11.1 | 10.8 | 10.8 |
| Kappa number | 4.8 | 4.7 | 4.6 | 4.5 | 4.3 | 4.2 |
| Viscosity, $dm^3/kg$ | 746 | 849 | 828 | 802 | 838 | 837 |
| Brightness, % ISO | 77.9 | 78.5 | 79.7 | 79.7 | 80.7 | 81.6 |
| Quantity of peroxide employed, kg/ADMT | 33 | 33 | 33 | 33 | 33 | 33 |
| Consumption of peroxide, kg/ADMT | 31 | 25 | 24 | 31 | 22 | 24 |

* in autoclaves with direct contact with the metal
** sealed in plastic bags and introduced into the autoclaves
*** sealed in plastic bags and introduced into the autoclaves filled with water for improved heat transfer It can be seen from Table I that the absence of contact between the pulp suspension and the metal surfaces directly affects the consumption of $H_2O_2$ and that the latter is also affected by the supply of heat to the pulp suspension, which can be seen from a comparison between columns b and c.

It is evident from Table 1 that the application of oxygen pressure (5 bar) improves the brightness by two units and gives better selectivity and a kappa reduction, which can be seen from the above table by comparing columns c and f.

Increasing the temperature by 10° C. from 90° C. to 100° C. approximately halves the reaction time required to achieve the same final brightness when using the same loading. This is shown in further experiments on the same pulp as in the above experiments. In this case all the experiments were carried out using an applied oxygen pressure of 5 bar. The experimental parameters and results are recorded in Table II below. By comparing I:f with II:e the temperature effect can be demonstrated.

TABLE II

| | a | b | c | d | e | f |
|---|---|---|---|---|---|---|
| Consistency, % | | | 10 | | | |
| Temperature, ° C. | | | 100 | | | |
| Time, minutes | 60 | 120 | 180 | 60 | 120 | 180 |
| Average pressure, bar (excess) | 5 | 5 | 5 | 5 | 5 | 5 |
| $MgSo_4$, kg/BDMT | 3 | 3 | 3 | 3 | 3 | 3 |
| $H_2O_2$, kg/BDMT | 25 | 25 | 25 | 35 | 35 | 35 |
| NaOH, kg/BDMT | 24 | 24 | 24 | 25 | 25 | 25 |
| Consumption of $H_2O_2$, kg/BDMT | 12.2 | 16.0 | 19.1 | 16.4 | 21.4 | 26.0 |
| Final pH | 10.8 | 10.6 | 10.4 | 10.7 | 10.5 | 10.4 |
| Kappa number | 5.3 | 4.6 | 4.2 | 5.0 | 4.3 | 4.0 |
| Viscosity, $dm^3/kg$ | 906 | 829 | 803 | 896 | 827 | 790 |
| Brightness, % ISO | 73.8 | 79.6 | 81.4 | 76.9 | 81.3 | 83.1 |
| Quantity of peroxide employed, kg/ADMT | 23 | 23 | 23 | 33 | 33 | 33 |
| Consumption of peroxide, kg/ADMT | 11 | 15 | 18 | 15 | 20 | 24 |

From the above Table II, it can also be seen that lowering the quantity of peroxide employed from 35 to 25 kg ptp (⅔) increases the reaction time which is required to achieve a brightness of 81.4 ISO from 2 to 3 hours, i.e. by lengthening the reaction time an economy can be achieved in the quantity of peroxide employed.

From a comparison between Table II:e and Table II:c it can be seen that lowering the quantity of peroxide employed from 35 to 25 kg ptp (to ⅔) increases the reaction time necessary for achieving a brightness of 81.4 ISO from 2 hours to 3 hours.

TABLE III

Comparative experiments at different temperatures.

| | a | b | c | d | e |
|---|---|---|---|---|---|
| Consistency, % | | | 10 | | |
| Temperature, ° C. | 90 | 90 | 100 | 100 | 110 |
| Time, minutes | | | 240 | | |
| Average pressure, bar (excess) | 0 | 5 | 0 | 5 | 5 |
| $MgSo_4$, kg/BDMT | 3 | 3 | 3 | 3 | 3 |
| $H_2O_2$, kg/BDMT | 35 | 35 | 35 | 35 | 35 |
| NaOH, kg/BDMT | 30 | 30 | 30 | 30 | 30 |
| Consumption of $H_2O_2$, kg/BDMT | 33.0 | 31.1 | 34.8 | 34.9 | 34.9 |
| Final pH | 11.4 | 11.3 | 11.1 | 11.3 | 10.0 |
| Kappa number | 4.6 | 4.4 | 4.4 | 3.5 | 3.9 |
| Viscosity, $dm^3$/kg | 707 | 733 | 660 | 685 | 675 |
| Brightness, % ISO | 77.4 | 81.4 | 76.4 | 80.6 | 80.8 |
| Quantity of peroxide employed, kg/ADMT | 33 | 33 | 33 | 33 | 33 |
| Consumption of peroxide, kg/ADMT | 31 | 29 | 32 | 32 | 32 |

- in autoclaves with direct contact with the metal
- note the effect of oxygen pressure In addition to this, further experiments have been carried out on the same pulp at oxygen pressures of 0–10 bar in order to demonstrate the importance of the temperature in combination with the oxygen pressure.

From the graph shown in FIG. 1, it can be seen, inter alia, that a Q(pressurised P)-sequence at 110° C. and 5 bar decreases the necessary reaction time from 4 hours to 1 hour as compared with that which is required under conventional atmospheric conditions at 90° C. In addition, the peroxide consumption which is necessary decreases by 25% to 18 kg ptp.

Figure 2:
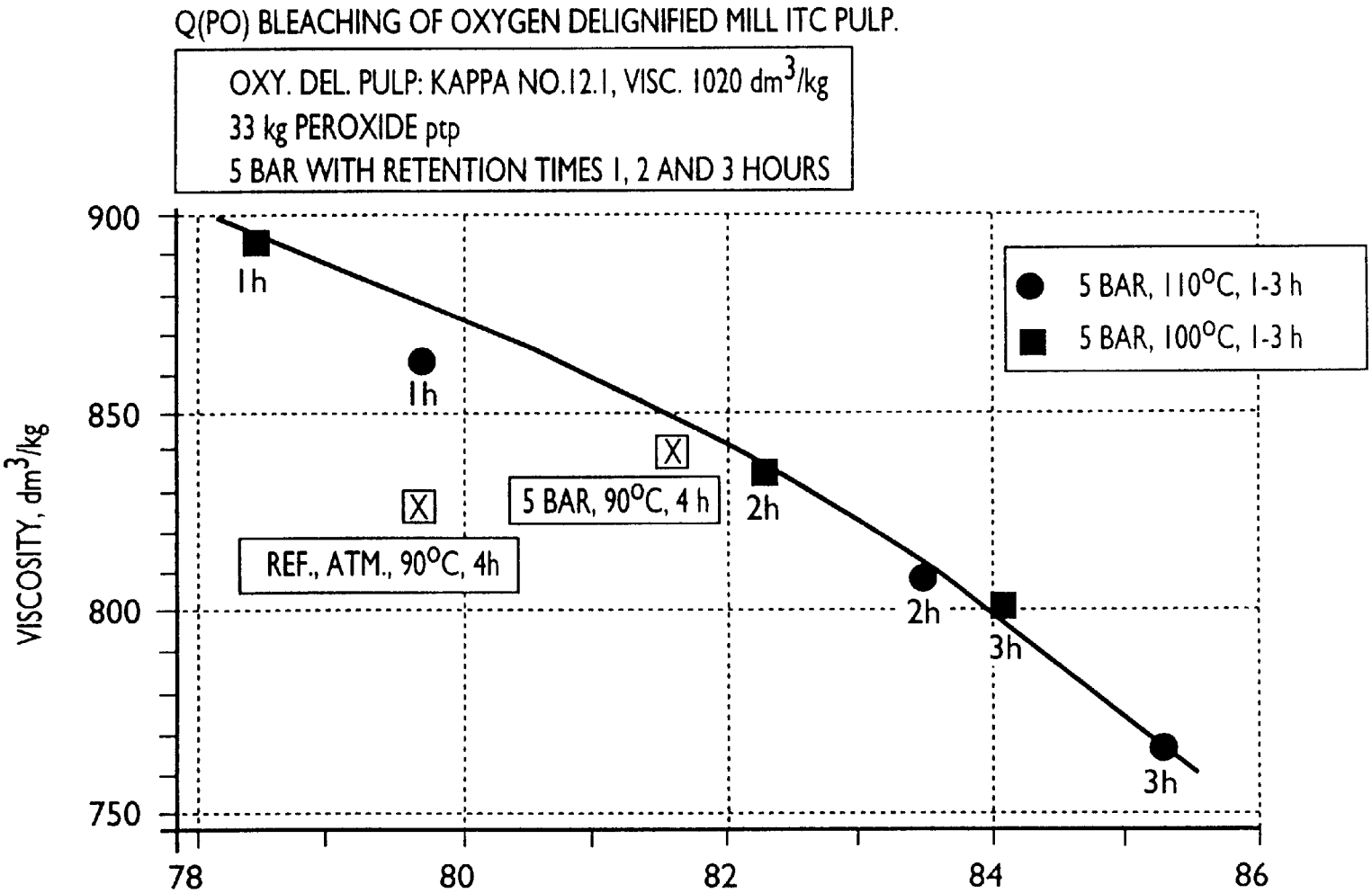
FIG. 2. shows a diagram of the relationship, during bleaching according to the invention, between brightness % ISO and viscosity, $dm^3$/kg, at either 5 bar and 100° C. or 5 bar and 110° C. for 1, 2 and 3 hours, and at 90° C., 0 bar and 4 hours, and at 90° C., 5 bar and 4 hours.

From the graph in FIG. 2 it can be seen, inter alia, that simply applying oxygen pressure at 90° C. increases the brightness by 2 steps from ~80 to ~82.

It has now emerged that there is a possibility of dividing the pressurised-P stage into two stages, with the first part of the process taking place, for example, at a lower temperature of 80–90° C. under atmospheric pressure and the second part taking place under applied oxygen pressure at 110–120° C., once the content of peroxide present in the pulp has declined.

Figure 3:
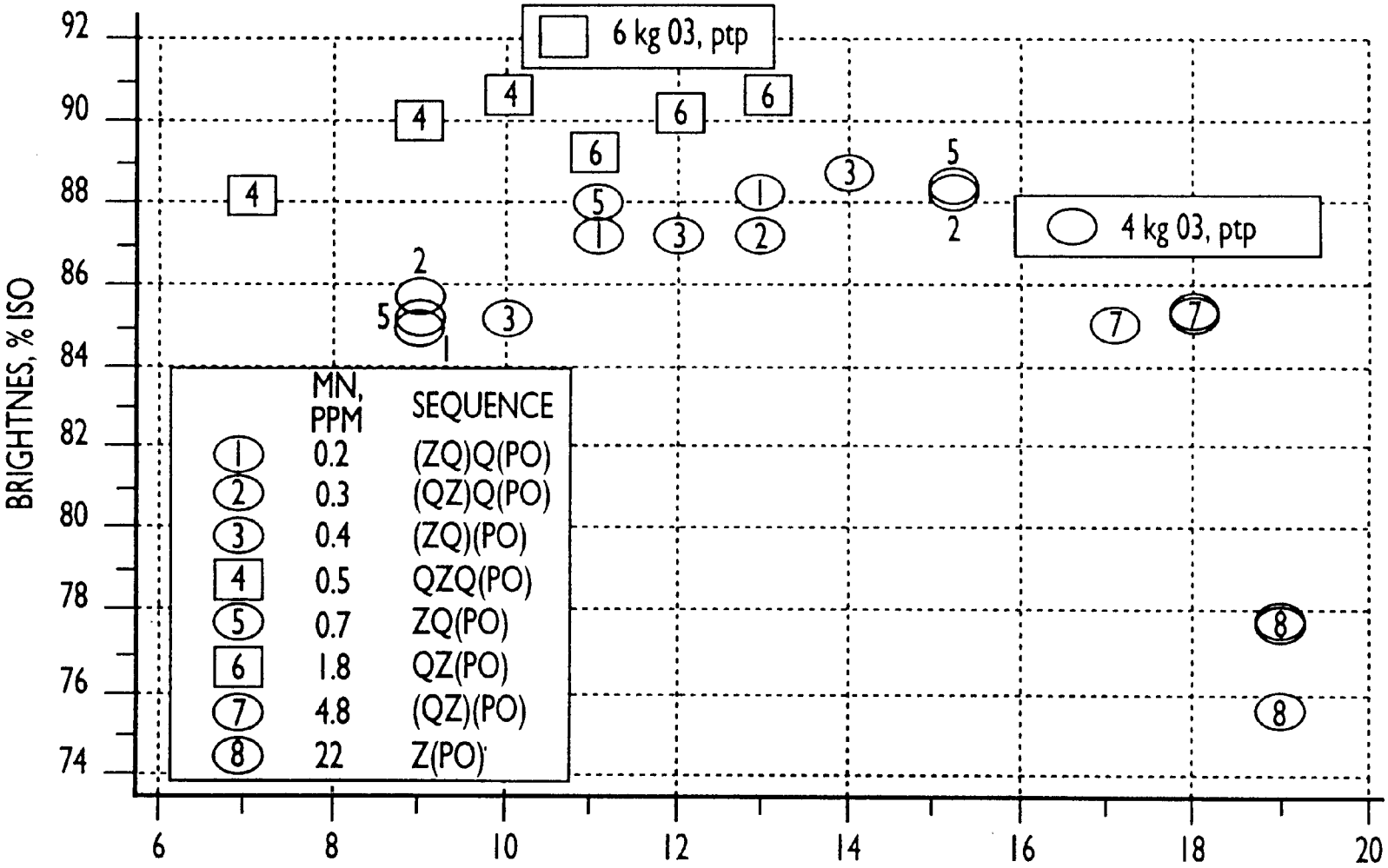
FIG. 3. shows a diagram of the relationship between brightness, % ISO, and total consumption of $H_2O_2$, kg/ADMT, during bleaching with a pressurised P stage according to the invention inserted in different bleaching sequences and with an ozone stage at 50° C. including a pressure of 6 kg or 4 kg and varying quantities of manganese.
Figure 4:
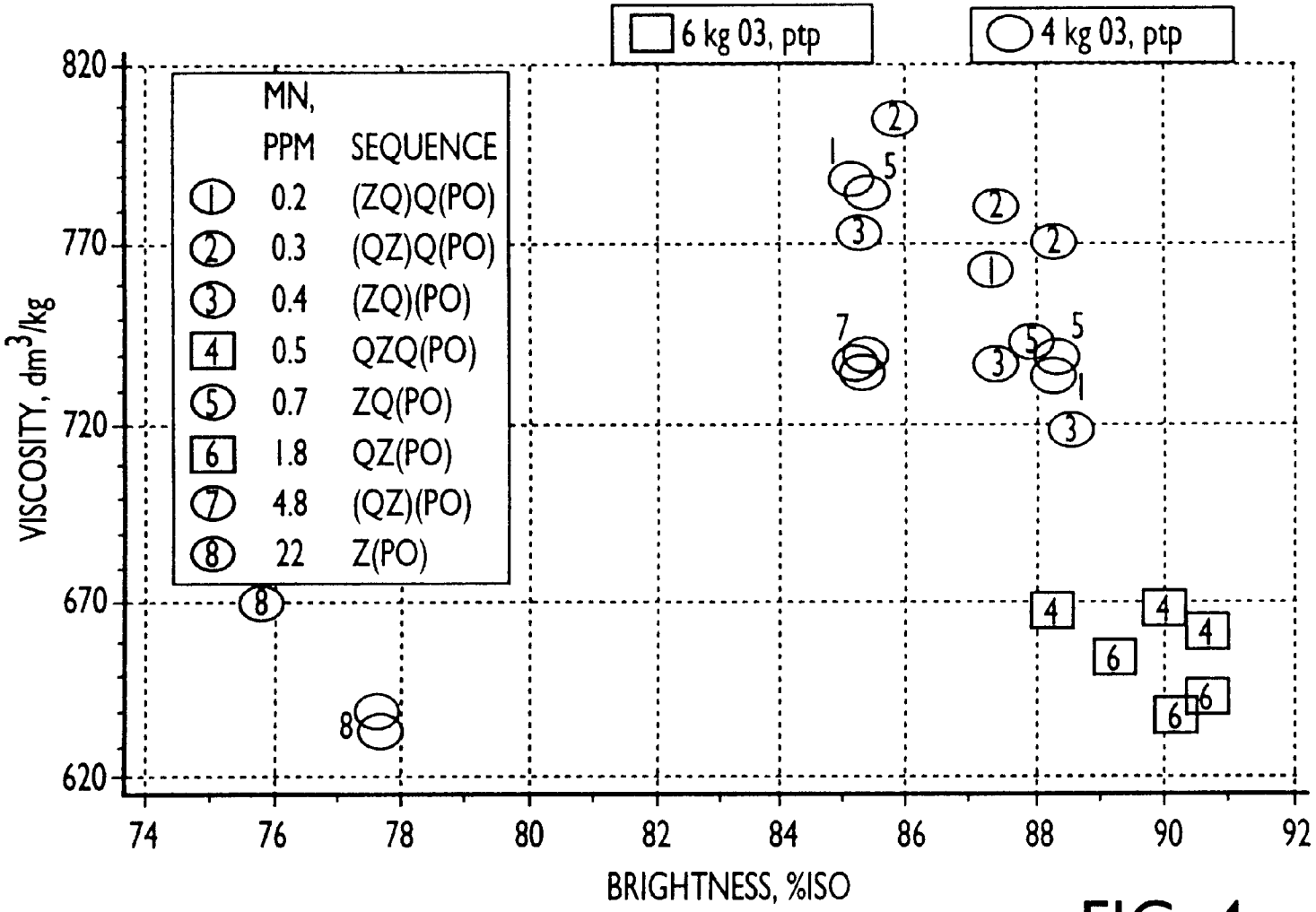
FIG. 4. shows a diagram (the same experimental series) of the relationship between brightness, % ISO, and viscosity, $dm^3$/kg, during bleaching with a pressurised P stage according to the invention inserted in different bleaching sequences and with an ozone stage at 50° C. including a pressure of 6 kg or 4 kg and varying quantities of manganese.

The importance of a Q treatment prior to a peroxide stage is already well known. If ozone is combined with the pressurised P stage, a simple 2-stage sequence can be used to produce marketable pulp of full brightness (88–90 ISO) and with good strength properties. See FIG. 3, where the total consumption of hydrogen peroxide has been related to the brightness in % ISO, and FIG. 4., where the viscosity has been related to the brightness in % ISO. The correlation between Mn content, brightness and hydrogen peroxide consumption or viscosity for a number of different sequences can clearly be seen in these graphs. As is evident from the sequence ZQ, the sequence ozone followed by a Q stage together with alkali, pH 5–6, without interpolated washing is consequently favourable for producing a low manganese content and good results.

The importance of the presence of manganese for peroxide consumption and pulp viscosity has been found to be crucial. Our experiments have demonstrated that every additional gram of manganese/BDMT of pulp increases the peroxide consumption by 2 kg/BDTM and lowers the quality of the pulp by 10 to 20 units in the SCAN viscosity ($dm^3$/kg). The degree of washing must exceed 95%, preferably 99%, in order to achieve these low manganese contents. It is best to use one or more, or a combination of, KAMYR atmospheric diffusers, KAMYR pressure diffusers or KAMYR washing presses in the bleaching line.

Figure 5:
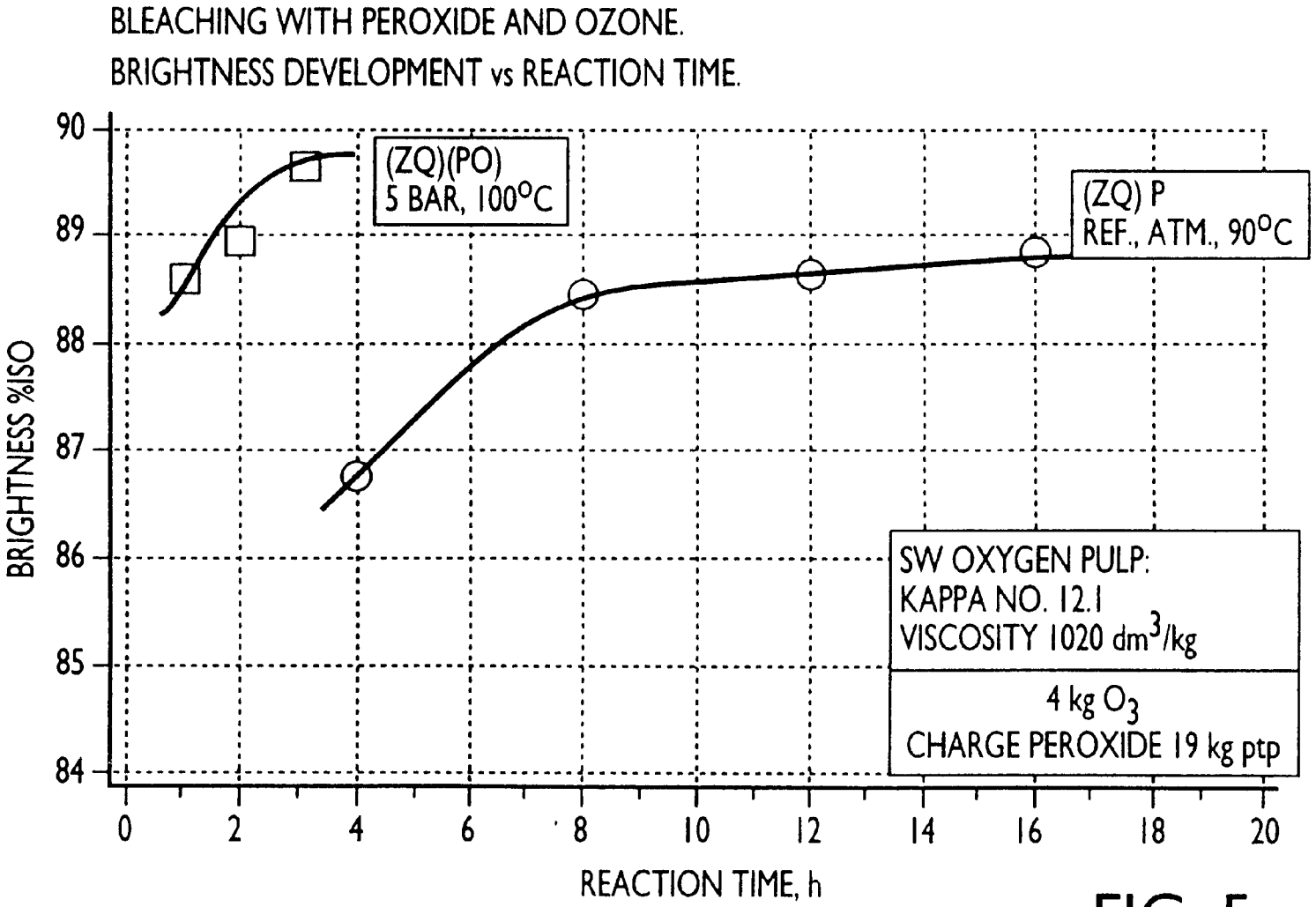
FIG. 5. shows a diagram of the relationship between brightness, % ISO, and reaction time for a bleaching sequence with a pressurised (PO) stage after a (QZ) stage according to the invention and a sequence for comparison at atmospheric pressure and 90° C.
Figure 6:
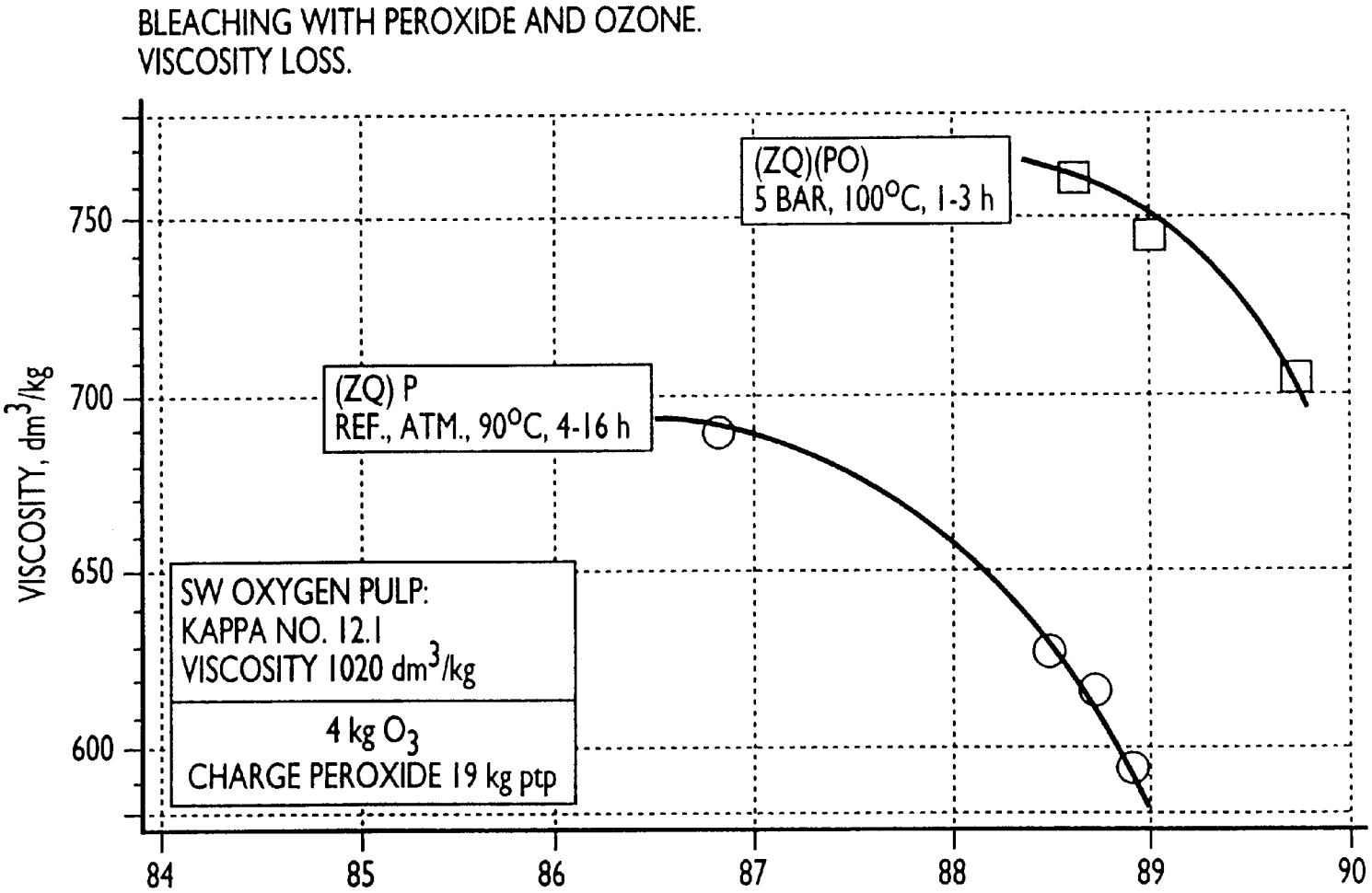
FIG. 6. shows a diagram of the relationship between brightness, % ISO, and viscosity, $dm^3$/kg, for the bleaching sequence in FIG. 5. according to the invention and a sequence for comparison at atmospheric pressure and 9° C.
Figure 7:
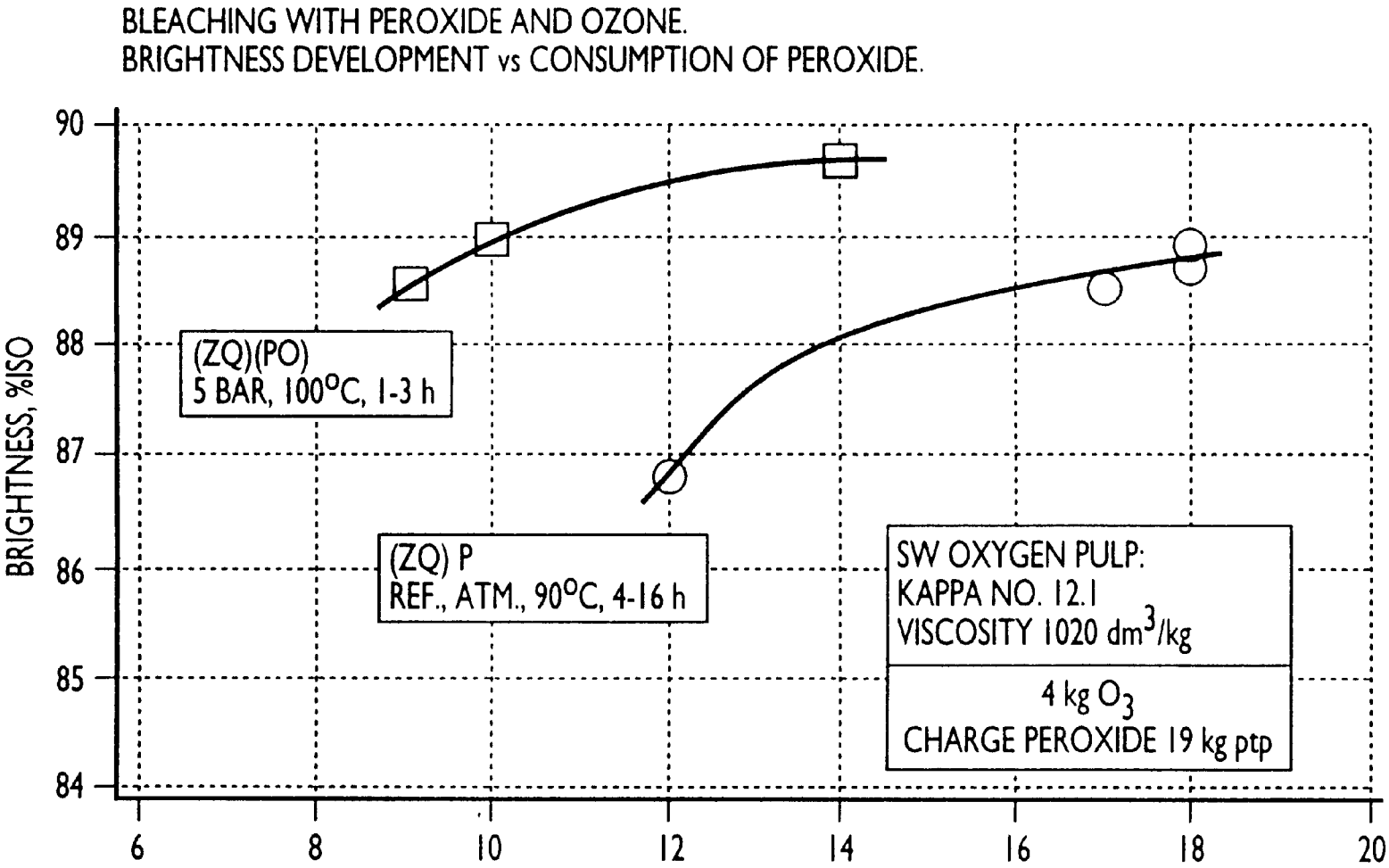
FIG. 7. shows a diagram of the relationship between brightness, % ISO, and total consumption of $H_2O_2$, kg/ADMT, for the bleaching sequence in FIG. 5. according to the invention and a sequence for comparison at atmospheric pressure at 90° C.

The appreciable advantages of having the pressurised (PO) stage after a (ZQ) stage, compared with conventional technology under atmospheric pressure, are evident from the graph in FIG. 5, where a decreased reaction time can be observed, from the graph in FIG. 6, where the process using a pressurised bleaching with peroxide and ozone leads to appreciably lower loss of viscosity, i.e. results in the achievement of higher pulp viscosity and higher brightness in relation to the reference experiment, and from the graph in FIG. 7 which demonstrates that, to achieve a brightness of 88–89% ISO according to the invention, the consumption of peroxide is halved as compared with reference experiments carried out under atmospheric pressure.

Figure 8:
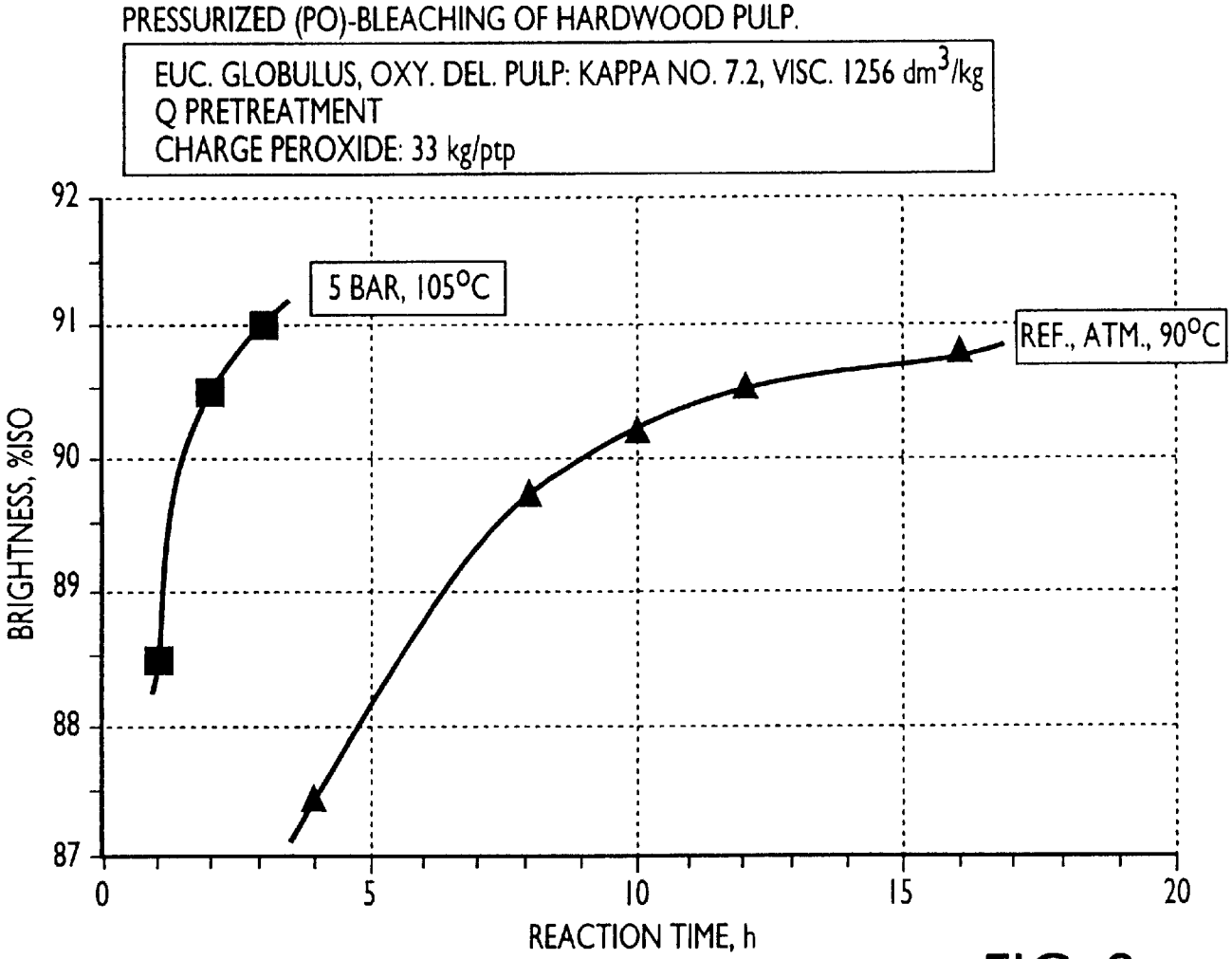
FIG. 8. shows a diagram of the relationship between brightness, % ISO, and reaction time for a bleaching sequence with a pressurised (PO) stage according to the invention and a sequence for comparison at atmospheric pressure and 90° C.
Figure 9:
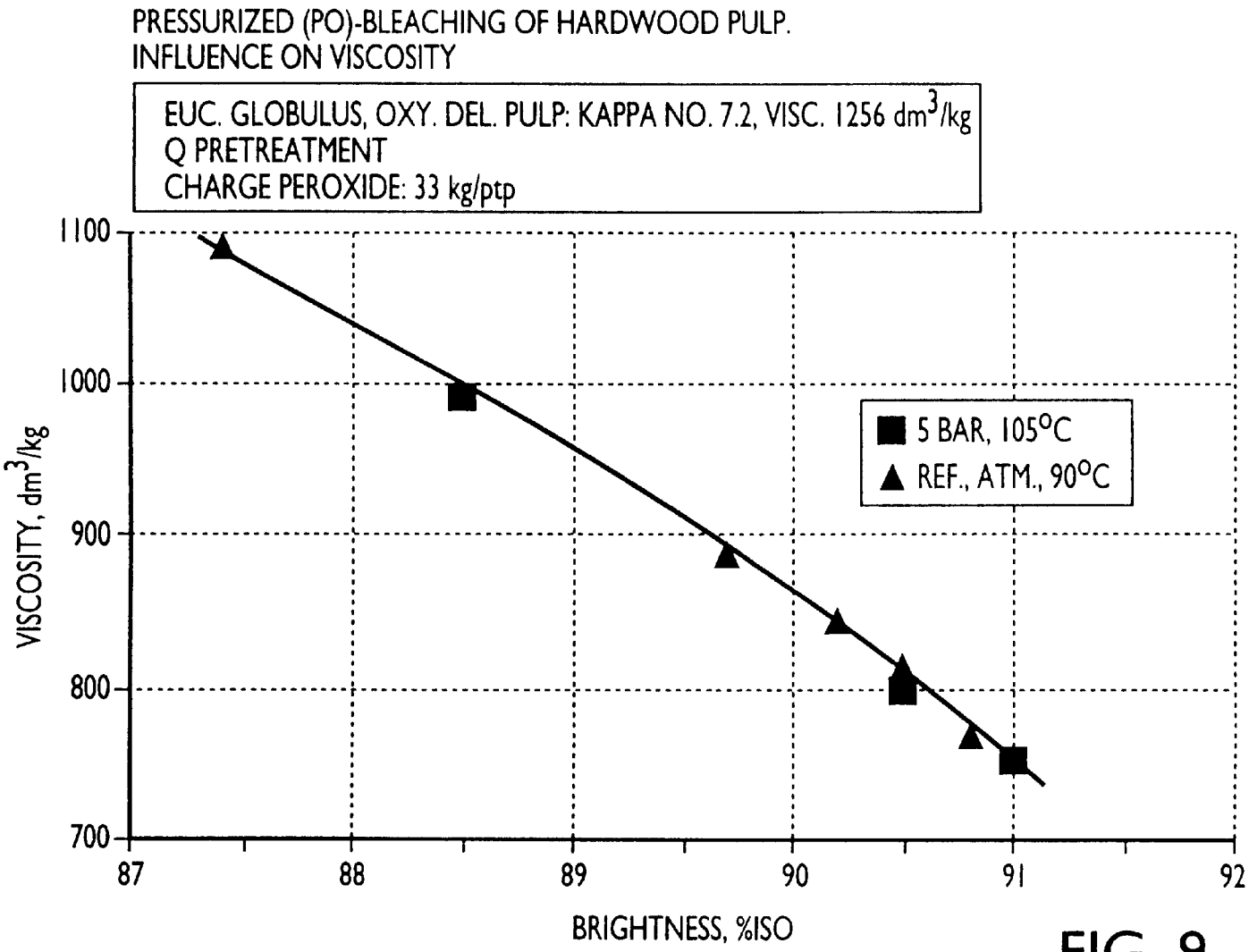
FIG. 9. shows a diagram of the relationship between brightness, % ISO, and viscosity, $dm^3/kg$, for a bleaching sequence in FIG. 8. according to the invention and a sequence for comparison at atmospheric pressure and 90° C.
Figure 10:
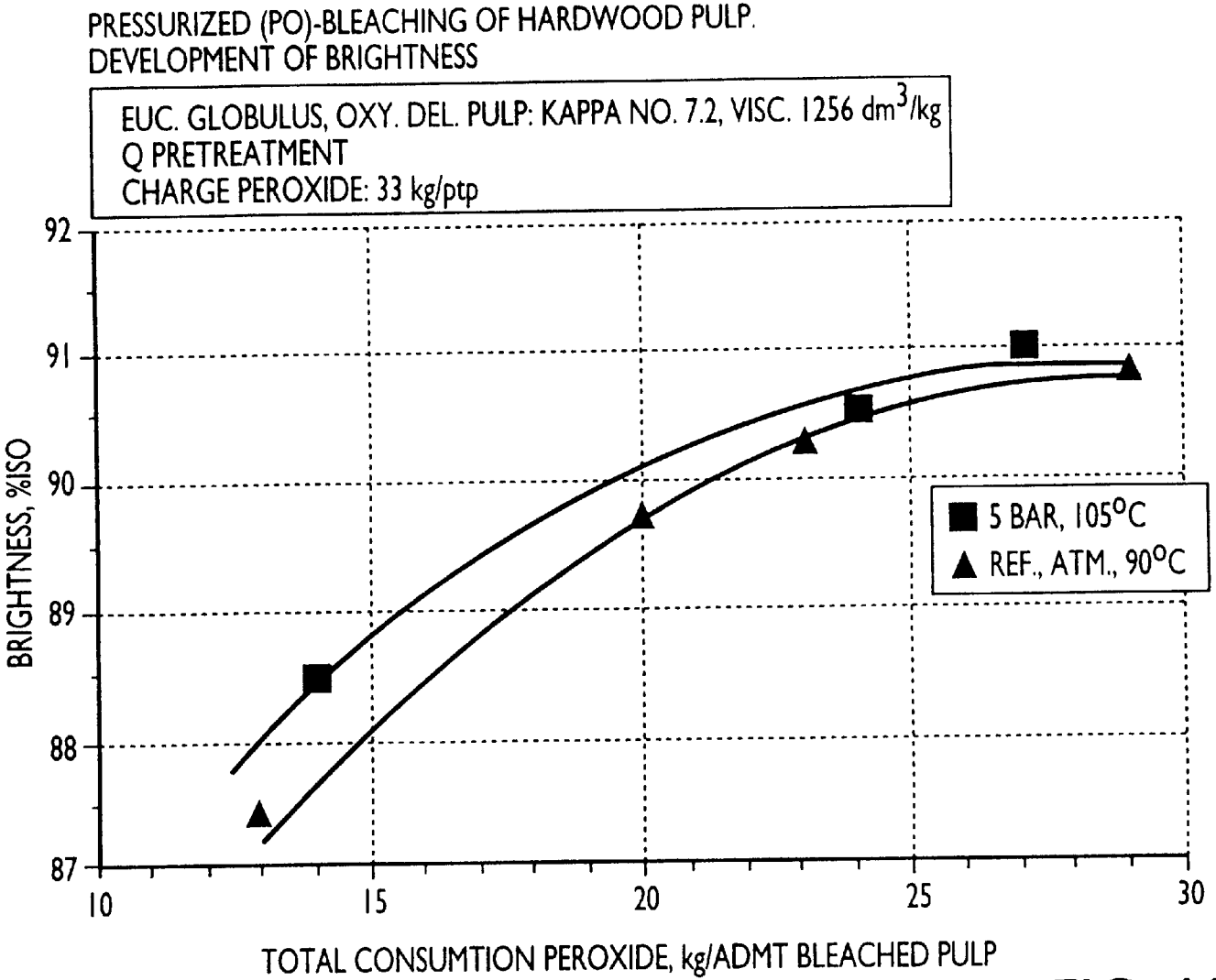
FIG. 10. shows a diagram of the relationship between brightness, % ISO, and total consumption of $H_2O_2$, kg/ADMT, for the bleaching sequence in FIG. 8. according to the invention and a sequence for comparison at atmospheric pressure and 90° C.

Comparative experiments have also been carried out (see FIGS. 8, 9 and 10) with regard to pressurised-(PO) bleaching of oxygen-delignified Euc. globulus, hardwood pulp, at 105° C., and bleaching of the same pulp under atmospheric pressure and at 90° C. The pulp having a kappa number of 7.2 was subjected to a preceding Q stage and the quantity of peroxide fed in was 33 kg/ptp.

Figure 11:
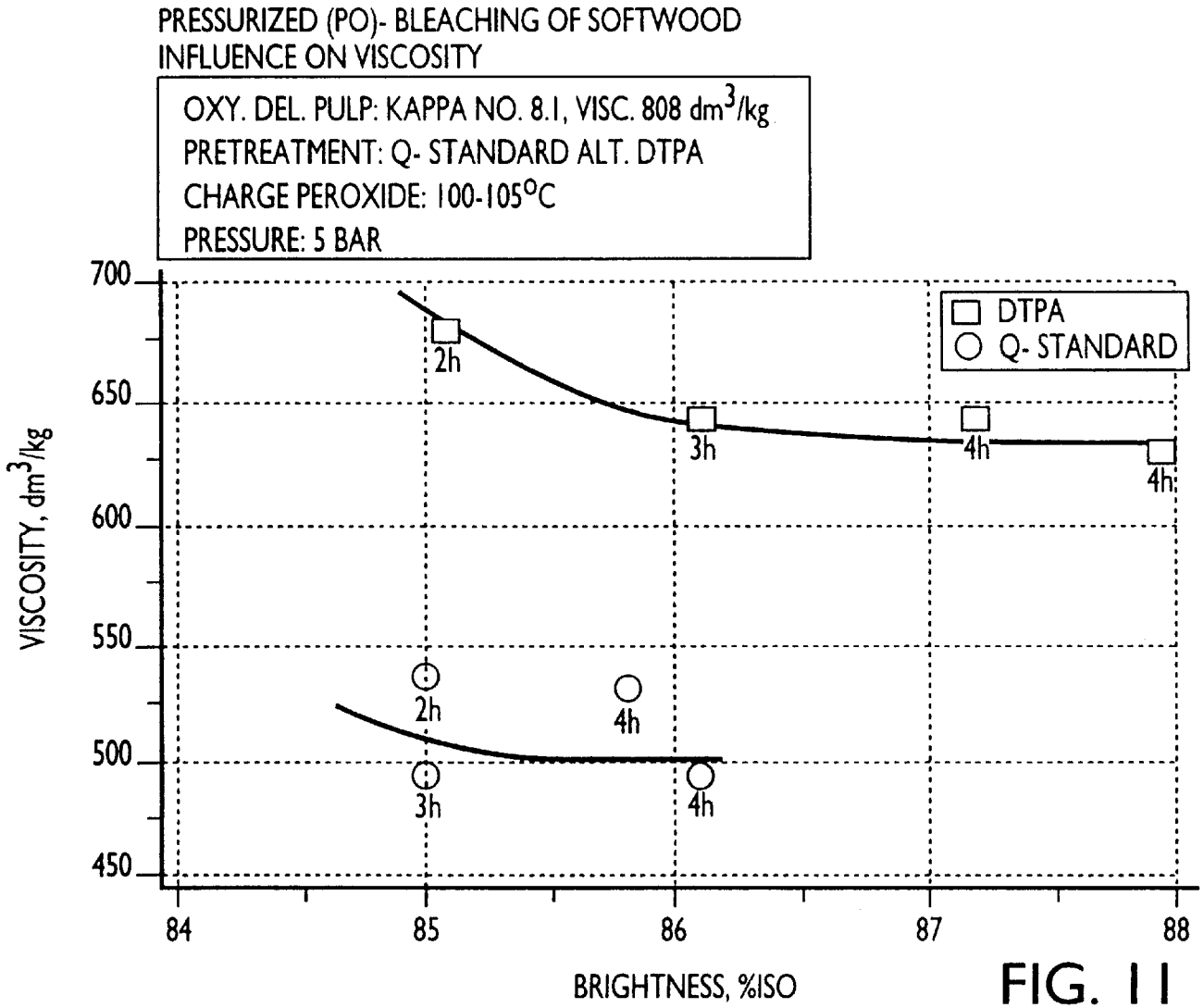
FIG. 11. Shows two diagrams of the relationship between brightness, % ISO, and viscosity, $dm^3/kg$, for pressurized (PO)-bleaching with either the standard Q pretreatment or the pretreatment using DTPA according to the invention. The first diagram shows bleaching of softwood the other one of softwood kraftpulp.

Comparative experiments have also been carried out (see FIG. 11) to show the influence on viscosity on two different softwood pulps in the pressurized (PO) stage bleaching from standard Q pretreatment and a pretreatment with DTPA, resp. One may note that the same brightness is reach in both cases in 3, resp. 4 hours and at the same viscosities.

Figure 12:
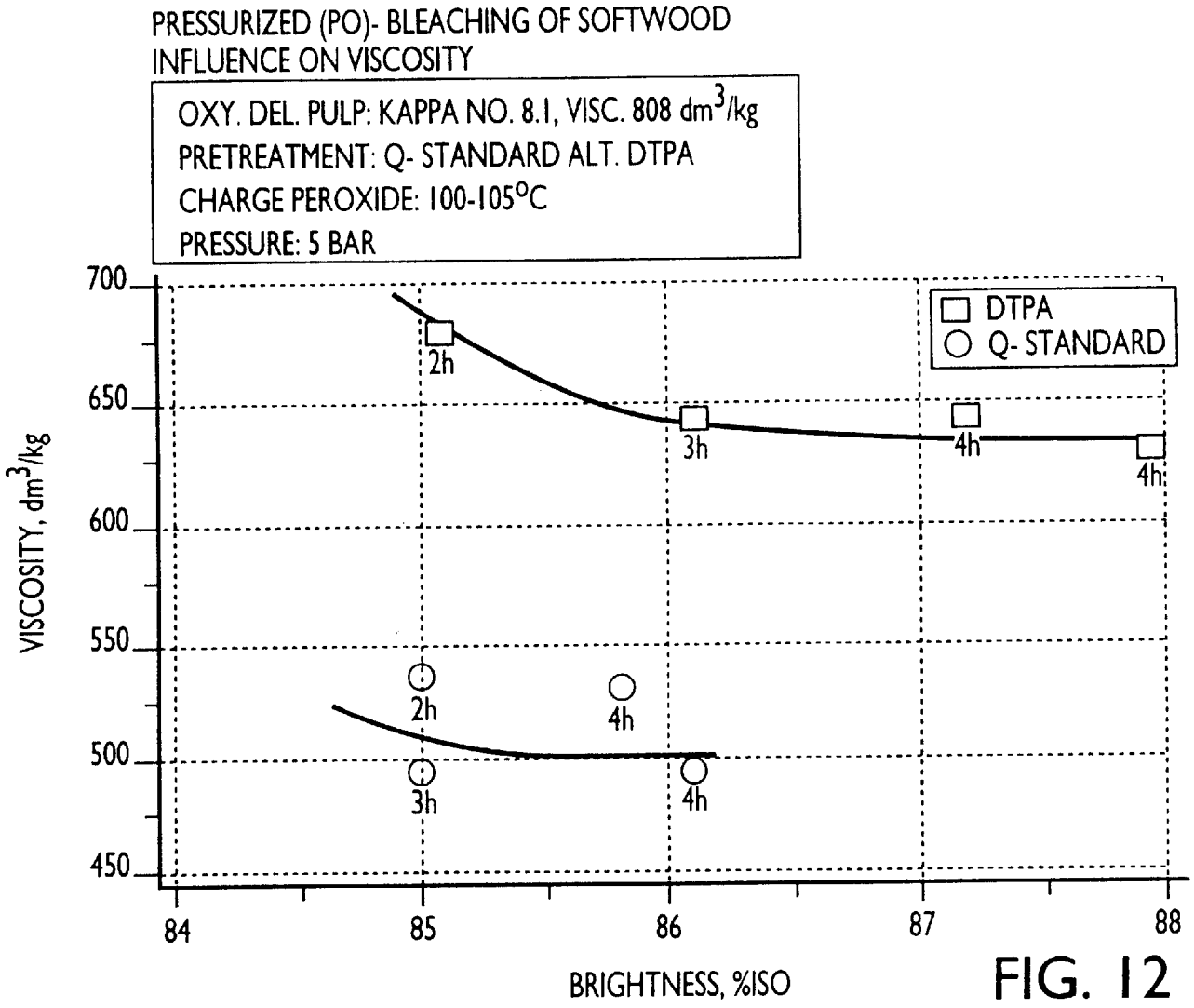
FIG. 12. shows a diagram of the influence of protectors (e.g. complexing agents) on the relationship between brightness, % ISO, and total consumption of $H_2O_2$, kg/ADMT, for a Q(PO)-bleaching of a lab. delignified pulp, and the relationship viscosity, dm3/kg, to brightness, % ISO, for the same.
Figure 13:
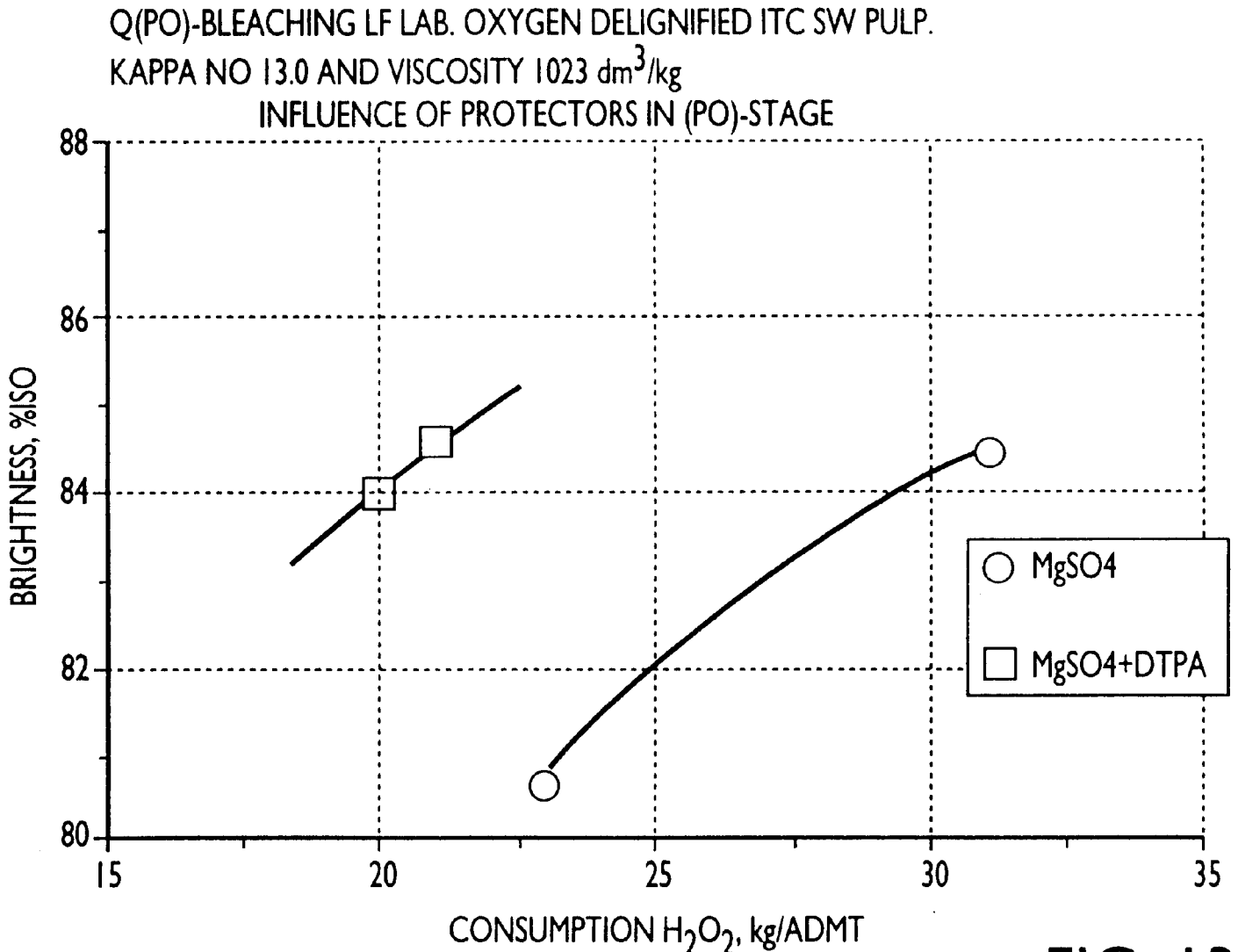
FIG. 13 shows a diagram of th e influence of protectors on the relationship between hydrogen peroxide Consumption and Brightness, % ISO for an oxygen delignified Q(PO) bleached softwood pulp.
Figure 14:
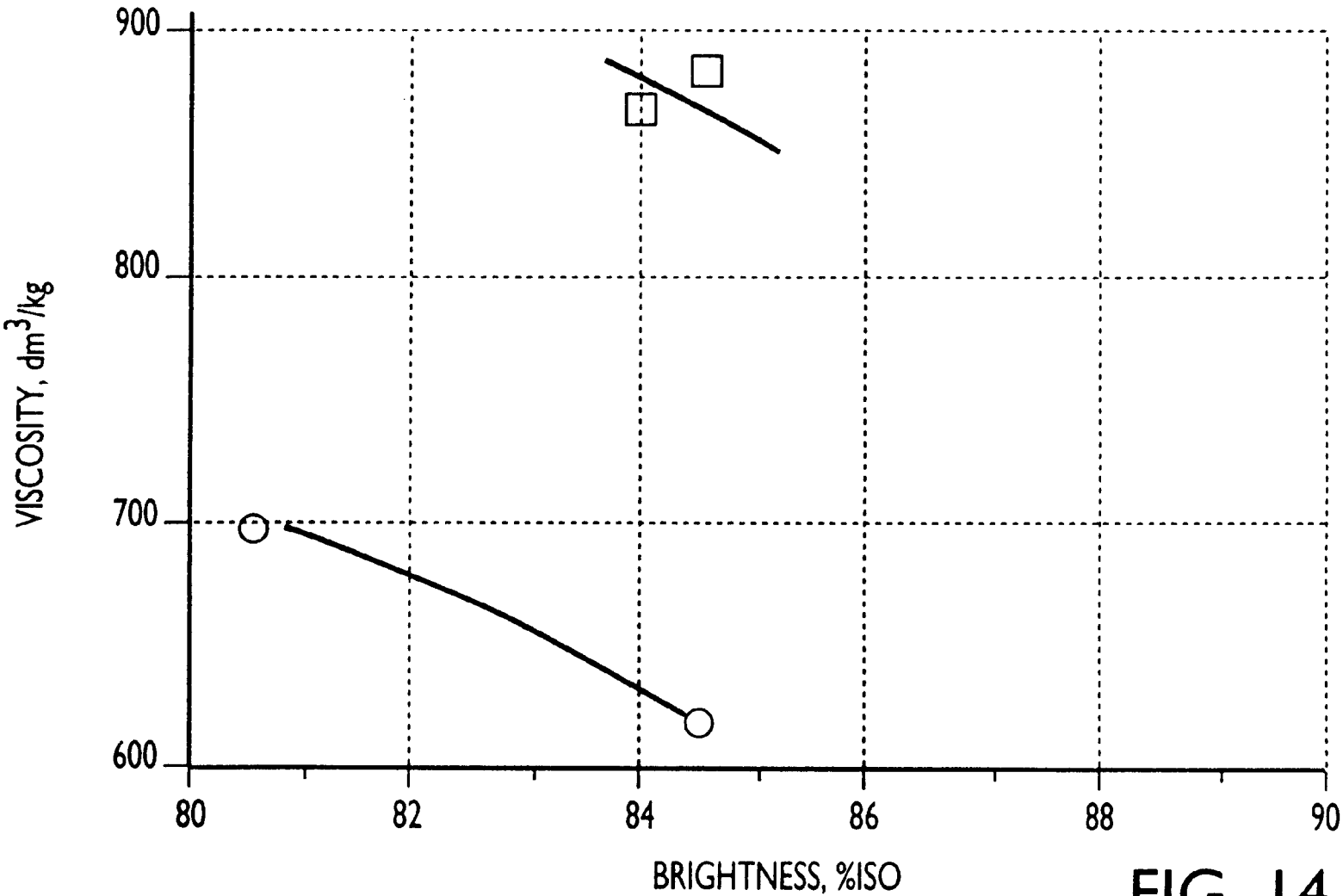
FIG. 14 shows a diagram of the relationship ween Brightness, % ISO and Viscosity.

Comparative experiments have also been carried out (see FIG. 12) to show the influence on viscosity as related to brightness and the consumption of $H_2O_2$ as related to brightness for different combinations in the (PO) stage. In the first diagram one may note the decrease in consumption of the peroxide adding DTPA, as compared to the addition of MgSO, alone.

The diagram also shows that $MgSO_4$ has been used. To use Mg as well as Ca, alone or in combination, in the process in order to improve the quality of the pulp, is known to the skilled man.

In the diagram below on may note the beneficial effects on the viscosity at the same brightness using the combination as above The object of the invention is to achieve a high degree of utilisation of the peroxide employed and at the same time to achieve a high degree of brightness in the product. As we have found out, this can be affected separately by a number of measures.

The invention is not limited to that which has been described above, but the features which have been described can advantageously be combined within the scope of the attached patent claims.

What is claimed is:

1. A process for chlorine-free bleaching of chemical pulp in association with the production thereof, using no chlorine and no chlorine compounds, comprising the steps of:

(a) providing a chemical pulp having a pulp suspension with a consistency exceeding 8% of cellulose-containing fiber material;

(b) treating the chemical pulp with at least one acid for adjusting the ph of the pulp to a value below 7;

(c) treating the pulp with a chelating agent;

(d) pumping said pulp into at least one bleaching vessel by means of a medium consistency pump to aid in pressurizing said bleaching vessel; and (e) bleaching the pulp in a bleaching stage to a brightness exceeding 75% ISO during the bleaching stage using hydrogen peroxide employed in a quantity exceeding 5 kg/BDMT or a corresponding quantity of another peroxide;

wherein said bleaching stage is effected in a bleaching vessel at a temperature exceeding 90° C. and at a pressure exceeding 2 bar, and an area of metal surface exposed on an interior of the bleaching vessel is less than 4V $m^2$, where V indicates a volume of the bleaching vessel in $m^3$.

2. The process according to claim 1, further comprising the step of adding at least one complexing agent to the pulp suspension which participates in the peroxide bleaching stage.

3. The process according to claim 2, wherein said complexing agent is added to the pulp suspension together with the peroxide.

4. The process according to claim 2, wherein said complexing agent substantially withstands a pH-value up to 11.

5. The process according to claim 2, wherein said complexing agent is DTPA.

6. The process according to claim 1, wherein said bleaching stage is carried out hydraulically, with no gas phase being present in the bleaching vessel.

7. The process according to claim 1, wherein a manganese content in the pulp supplied to the bleaching stage is less than 5 g/BDMT of pulp.

8. The process according to claim 7, wherein said manganese content is less than 1 g/BDMT of pulp.

9. The process according to claim 7, wherein said manganese content is less than 0.5 g/BDMT of pulp.

10. The process according to claim 7, wherein the manganese content in the pulp supplied to the bleaching stage is largely the same as a manganese content in the finally bleached pulp.

11. The process according to claim 1, further comprising the step of adding oxygen to the pulp suspension, in connection with the bleaching stage, in a quantity less than 5 kg/BDMT of pulp.

12. The process according to claim 1, further comprising the step of adding oxygen to the pulp suspension, in connection with the bleaching stage, in a quantity less than 3 kg/BDMT of pulp.

13. The process according to claim 1, further comprising the step of adding oxygen to the pulp suspension, in connection with the bleaching stage, in a quantity less than 1 kg/BDMT of pulp.

14. The process according to claim 1, wherein the quantity of peroxide employed in the bleaching stage exceeds 10 kg/BDMT.

15. The process according to claim 1, wherein the quantity of peroxide employed in the bleaching stage exceeds 10 kg/BDMT and is less than 35 kg/BDMT.

16. The process of claim 1, further comprising after treating the pulp with the chelating agent, washing the pulp, the washing step having a washing exceeding 95%.

17. The process of claim 16, wherein the washing exceeds 99%.

18. The process of claim 1, further comprising after treating the pulp with the chelating agent, adding an alkali agent.

19. A process for chlorine-free bleaching of chemical pulp in association with the production thereof, using no chlorine and no chlorine compounds, comprising the steps of:

(a) providing a chemical pulp having a pulp suspension with a consistency exceeding 8% of cellulose-containing fiber material;

(b) treating the chemical pulp with at least one acid for adjusting the pH of the pulp to a value below 7;

(c) treating the pulp with a chelating agent;

(d) pumping said pull) into at least one bleaching vessel by means of a medium consistency pump to aid in pressurizing said bleaching vessel;

adding hydrogen peroxide in a quantity exceeding 5 kg/BDMT or a corresponding quantity of another peroxide to said pulp in suspension;

(f) adding at least one complexing agent to the pulp suspension together with the peroxide, said complexing agent comprising DTPA which substantially withstands a ph-value up to 11; and (g) bleaching the pulp in a bleaching stage to a brightness exceeding 75% ISO during the bleaching stage, said bleaching stage being effected in a bleaching vessel at a temperature exceeding 90° C. and at a pressure exceeding 2 bar, an area of metal surface exposed on an interior of the bleaching vessel being less than 4V $m^2$, where V indicates a volume of the bleaching vessel.

20. A process for chlorine-free bleaching of chemical pulp in association with the production thereof, using no chlorine and no chlorine compounds, comprising the steps of:

(a) providing a chemical pulp having a pulp suspension with a consistency exceeding 8% of cellulose-containing fiber material;

(b) treating the chemical pulp with at least one acid for adjusting the pH of the pulp to a value below 7;

(c) treating the pulp with a chelating agent;

(d) pumping said pulp into at least one bleaching vessel be means of a medium consistency pump to aid in pressurizing said bleaching vessel; and (e) bleaching the pulp in a bleaching stage to a brightness exceeding 75% ISO during the bleaching stage using hydrogen peroxide employed in a quantity exceeding 5 kg/BDMT or a corresponding quantity of another peroxide;

wherein said bleaching stage is effected in a bleaching vessel at a temperature equal to or exceeding 100° C. and at a pressure exceeding 3 bar, and an area of metal surface exposed on an interior of the bleaching vessel is less than 4V $m^2$, where V indicates a volume of the bleaching vessel in $m^3$.

21. The process according to claim 20, wherein the temperature in said bleaching vessel during said bleaching stage is between 100° C. and 105° C.

22. The process according to claim 20, wherein the pressure in said bleaching vessel during said bleaching stage is within the range of 5 to 10 bar.

23. A process for chlorine-free bleaching of chemical pulp in association with the production thereof, using no chlorine and no chlorine compounds, comprising the steps of:

(a) providing a chemical pulp having a pulp suspension with a consistency exceeding 8% of cellulose-containing fiber material;

(b) treating the chemical pulp with at least one acid for adjusting the pH of the pulp to a value below 7;

(c) treating the pulp with a chelating agent;

(d) pumping said pulp into at least one bleaching vessel by means of a medium consistency pump to aid in pressurizing said bleaching vessel;

(e) adding hydrogen peroxide to the pulp suspension in a quantity exceeding 5 kg/BDMT or a corresponding quantity of another peroxide;

(f) adding oxygen to the pulp suspension in a quantity which is less than 5 kg/BDMT of pulp; and (g) bleaching the pulp in a bleaching stage to a brightness exceeding 75% ISO during the bleaching stage, said bleaching stage being effected in a bleaching vessel at a temperature exceeding 90° C. and at a pressure exceeding 2 bar, an area of metal surface exposed on an interior of the bleaching vessel being less than 4V $m^2$, where V indicates a volume of the bleaching vessel in $m^3$.

24. The process according to claim 23, wherein the quantity of oxygen added to the pulp suspension is less than 3 kg/BDMT of pulp.

25. The process according to claim 23, wherein the quantity of oxygen added to the pulp suspension is less than 1 kg/BDMT of pulp.

* * * * *